US006007396A

United States Patent [19]

Williams

[11] Patent Number: 6,007,396

[45] Date of Patent: Dec. 28, 1999

[54] FIELD EMITTER FABRICATION USING MEGASONIC ASSISTED LIFT OFF

[75] Inventor: Dale A. Williams, San Jose, Calif.

[73] Assignee: Candescent Technologies Corporation, San Jose, Calif.

[21] Appl. No.: 08/847,119

[22] Filed: Apr. 30, 1997

[51] Int. Cl.[6] ..... H01J 9/02

[52] U.S. Cl. ..... 445/24

[58] Field of Search ..... 445/24, 50

[56] References Cited

U.S. PATENT DOCUMENTS 5,534,743 7/1996 Jones et al. ..... 313/309

5,584,739 12/1996 Itoh et al. ..... 445/24

*Primary Examiner*—Kenneth J. Ramsey

*Attorney, Agent, or Firm*—Wagner, Murabito & Hao LLP

[57] ABSTRACT

In a field emitter structure, a method for removing a lift-off layer and an overlying closure layer. In one embodiment, a field emitter structure includes a cavity formed into an insulating layer overlying at least a portion of a first electrically conductive layer. A second electrically conductive layer has an opening formed above the cavity. The second electrically conductive layer has lift-off layer and a closure layer disposed thereon. The present invention removes the lift-off layer and the closure layer from the second electrically conductive layer according to the following method. First, the present invention immerses the field emitter structure in an etchant which attacks the lift-off layer. Next, the present invention activates a transducer immersed in the etchant to subject the lift-off layer of the field emitter structure to vibrational forces generated by the transducer. The vibrational forces, in conjunction with the etchant, causes the lift-off layer and the overlying closure layer to be removed from the second electrically conductive layer. The present invention then removes the field emitter structure from the etchant, removes residual etchant from the field emitter structure, and dries the field emitter structure using a Marangoni drying process.

19 Claims, 8 Drawing Sheets

FIELD EMITTER FABRICATION USING MEGASONIC ASSISTED LIFT OFF

TECHNICAL FIELD

The present claimed invention relates to the field of flat panel displays. More specifically, the present claimed invention relates to the removal of lift-off and closure layers in a field emitter structure.

BACKGROUND ART

Field emission cathodes are electron emitting devices which are used, for example, in flat panel displays. A field emission cathode or "field emitter" emits electrons when subjected to an electric field of sufficient strength. A side sectional view depicting conventional steps used to manufacture a field emission cathode is shown in Prior Art FIG. 1A. More specifically, in Prior Art FIG. 1A, a first conductive layer or "row electrode" 102 has a resistive layer 104 disposed thereon. An inter-metal dielectric layer 106 disposed above resistive layer 104 has a cavity 108 formed therein. As shown in Prior Art FIG. 1A, a second conductive layer or gate electrode 110 resides above inter-metal dielectric layer 106. A hole or opening 112 is formed through gate electrode 110 directly above cavity 108. Opening 112 is used to form the field emitter which will reside within cavity 108. Typically, the formation of the field emitter is accomplished, in part, using a lift-off or "parting layer", and a closure layer.

With reference next to Prior Art FIG. 1B, a side sectional view illustrating the deposition of a lift-off layer 114 is shown. Lift-off layer 114 is commonly formed using an angled physical vapor deposition of, for example, aluminum. Arrows 118 illustrate the angled nature of the deposition of lift-off layer 114. The angled deposition of lift-off layer 114 is required to insure that no lift-off layer material, i.e. aluminum, is deposited into the bottom of cavity 108. In order to achieve an angled deposition, the entire field emitter structure must be rotated during the deposition of lift-off layer 114.

Referring next to Prior Art FIG. 1C, a side sectional view illustrating the initial formation of a closure layer 118 is shown. Closure layer 118 is comprised of electron emissive material such as, for example, molybdenum. The electron emissive material which forms closure layer 118 is also deposited into cavity 108 as shown by structure 120. Typically, the electron emissive material is deposited using, for example, an e-beam evaporative deposition method.

Referring now to Prior Art FIG. 1D, a side sectional view illustrating a completed deposition of electron emissive material is shown. As shown in Prior Art FIG. 1D, closure layer 118 completely seals cavity 108. Additionally, as the electron emissive material is deposited as shown in Prior Art FIGS. 1C and 1D, an electron emitting structure 120 commonly referred to as a "Spindt-type" emitter is formed within cavity 108 (Spindt-type emitters are described in detail in U.S. Pat. No. 3,665,241 to Spindt et al. which is incorporated herein by reference as background material). After emitter 120 is formed, closure layer 118 must be removed.

With reference now to Prior Art FIG. 1E, a side sectional view illustrating the removal of closure layer 118 is shown. When removing closure layer 118, care must be taken not to damage or otherwise adversely affect emitter 120. Such a removal process is further complicated by the fact that both closure layer 118 and emitter 120 are formed of the same electron emissive material. Prior art techniques remove closure layer 118 by etching lift-off layer 114 using an etchant which attacks the aluminum lift-off layer 114. As a result, lift-off layer 114 "lifts" from underlying gate electrode 110 and, consequently, removes closure layer 118, as illustrated in Prior Art FIG. 1E.

Unfortunately, such prior art lift-off and closure layer removal methods typically expose the field emitter structure to the etchant for an extended period of time. Specifically, some prior art lift-off layer and closure layer removal processes expose the field emitter structure to an etchant for as long as hours. Such extended exposure to the etchant results in damage to the emitters. Such prior art lift-off and closure layer removal processes also result in the generation of flakes or contaminating chunks, typically shown as 122*a*–122*d*, which contaminate the etchant. Flakes or chunks 122*a*–122*d* can also redeposit within or over cavity 108, as shown by chunk 122*c*, and compromise the integrity of emitter 120 formed therein. As a result, the emitter can be severely damaged or even shorted to gate electrode 110, or otherwise affect emission.

Conventional lift-off and closure layer removal methods are not always entirely effective. That is, additional subsequent process steps may be necessary to insure that the lift-off and closure layer are completely removed. As an example, some prior art methods require that the lift-off and closure layer be physically rubbed from the gate electrode even after prolonged exposure to the etchant. Other prior art methods apply a tape to the closure layer after exposure to the etchant. The tape adheres to those portion of the lift-off and closure layers which remain on the gate electrode. The remaining portions of the lift-off and closure layers are then removed by peeling the tape from the field emitter structure. Such post-etch lift-off and closure layer removal process are extremely time-consuming, labor-intensive, and are not well suited for high volume production.

As yet another drawback, conventional lift-off and closure layer removal processes are not well suited for use with field emitter structures containing focusing walls. That is, prolonged exposure to various prior art etchants can deteriorate the focus walls. Also, in prior art approaches, the focus walls can prevent portions of lifted or detached lift-off and closure layers from migrating away from the gate electrode. As a result, the lifted lift-off and closure layer will redeposit back onto the gate electrode. Additionally, post-etch processes such as hand-rubbing or tape-peeling of the lift-off and closure layers is further complicated by the presence of focus wall structures.

Thus, a need exists for a lift-off and closure layer removal method which does not require exposing the field emitter structure to etchants for a prolonged period of time. A further need exists for a lift-off and closure layer removal method which does not require subsequent rubbing or tape-peeling processes to completely remove the lift-off and closure layers. Still another need exists for a lift-off and closure layer removal method which is compatible with the use of focus walls.

DISCLOSURE OF THE INVENTION

The present invention provides a lift-off and closure layer removal method which does not require exposing the field emitter structure to etchants for a prolonged period of time. The present invention further provides a lift-off and closure layer removal method which does not require subsequent rubbing or tape-peeling processes to completely remove the lift-off and closure layers. Additionally, the present invention provides a lift-off and closure layer removal method which is compatible with the use of focus walls.

Specifically, in one embodiment, a field emitter structure includes a cavity formed into an insulating layer overlying at least a portion of a first electrically conductive layer. A second electrically conductive layer has an opening formed above the cavity. The second electrically conductive layer has lift-off layer and a closure layer disposed thereon. The present invention removes the lift-off layer and the closure layer from the second electrically conductive layer according to the following method. First, the present invention immerses the field emitter structure in an etchant which attacks the lift-off layer. Next, the present invention activates a transducer immersed in the etchant to subject the lift-off layer of the field emitter structure to vibrational forces generated by the transducer. The vibrational forces, in conjunction with the etchant, causes the lift-off layer and the overlying closure layer to be removed from the second electrically conductive layer. The present invention then removes the field emitter structure from the etchant, removes residual etchant from the field emitter structure, and dries the field emitter structure using a Marangoni drying process.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

Prior Art

Prior Art

Prior Art

Prior Art

Prior Art

DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1A:
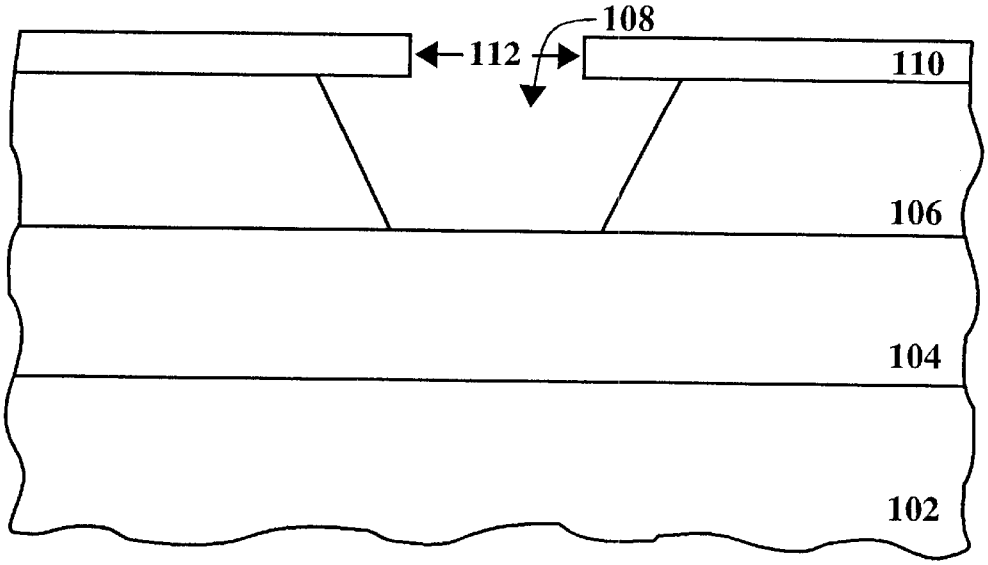
FIG. 1A (Prior Art)
FIG. 1A is a side sectional view of a field emitter structure prior to the deposition of a lift-off layer.
Figure 1B:
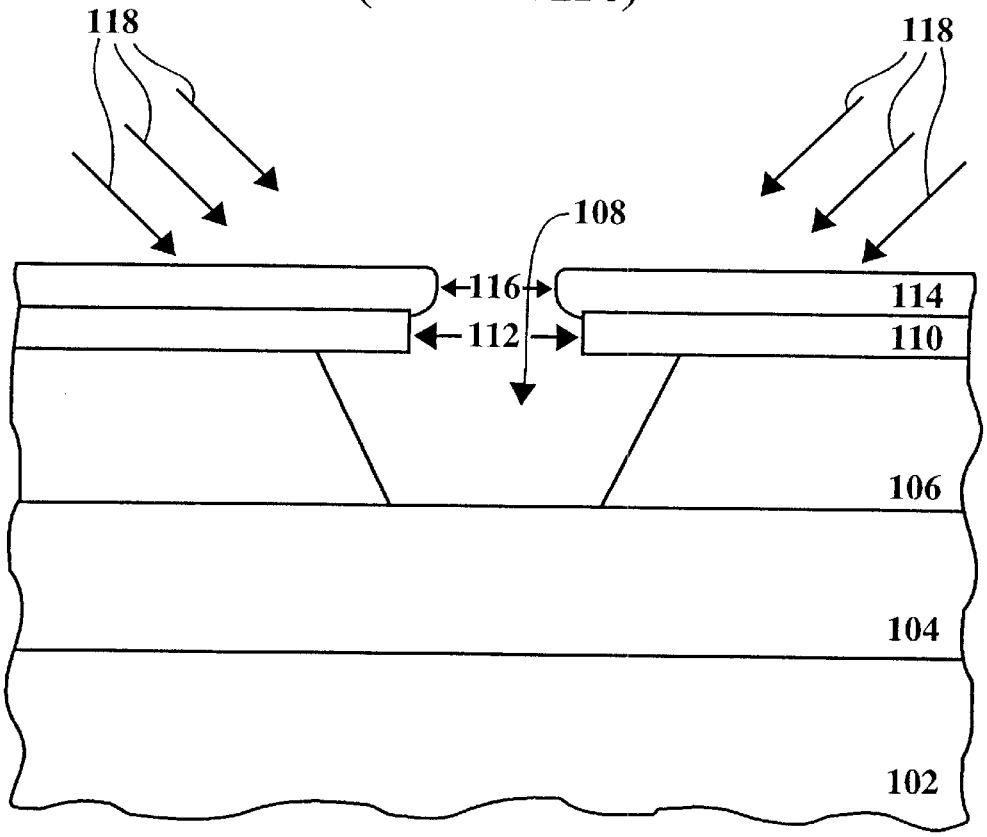
FIG. 1B (Prior Art)
FIG. 1B is a side sectional view illustrating the deposition of a liftoff layer.
Figure 1C:
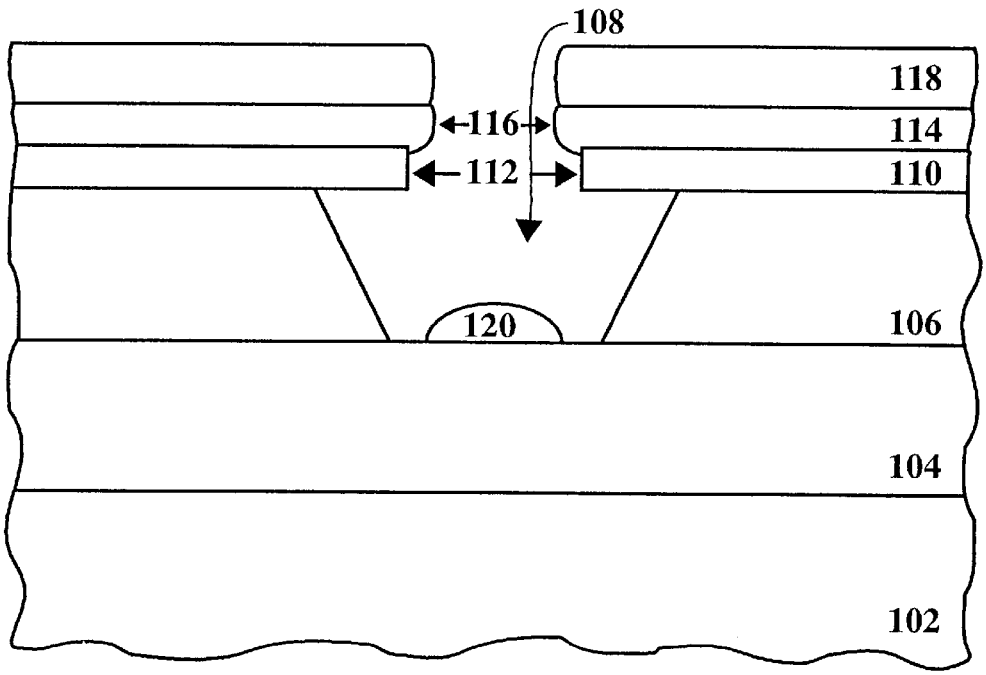
FIG. 1C (Prior Art)
FIG. 1C is a side sectional view illustrating the initial formation of a closure layer.
Figure 1D:
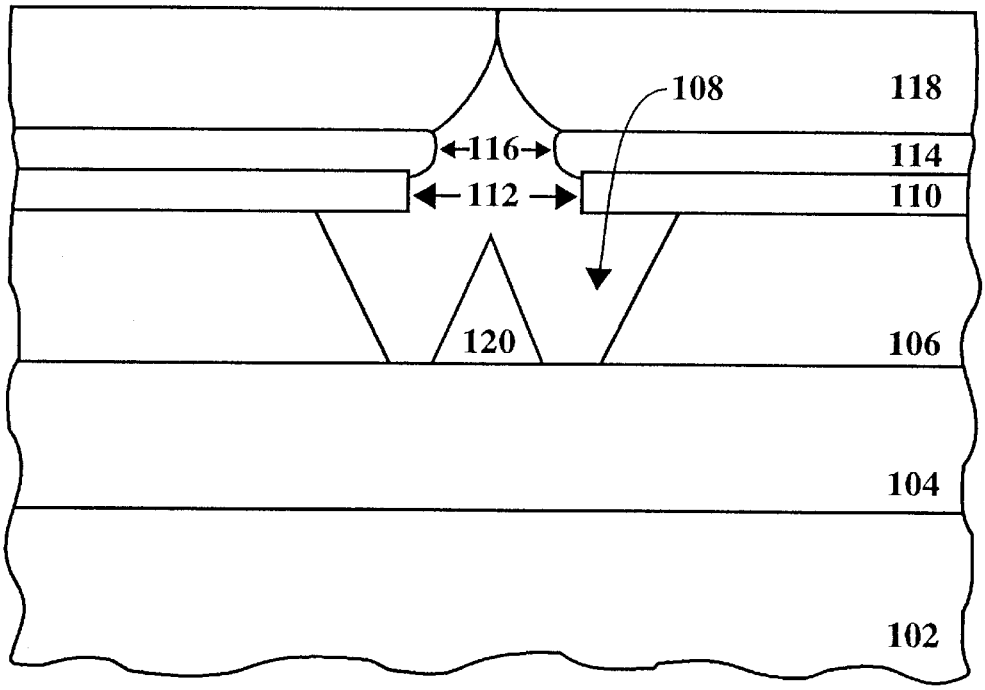
FIG. 1D (Prior Art)
FIG. 1D is a side sectional view illustrating a completed deposition of electron emissive material.
Figure 1E:
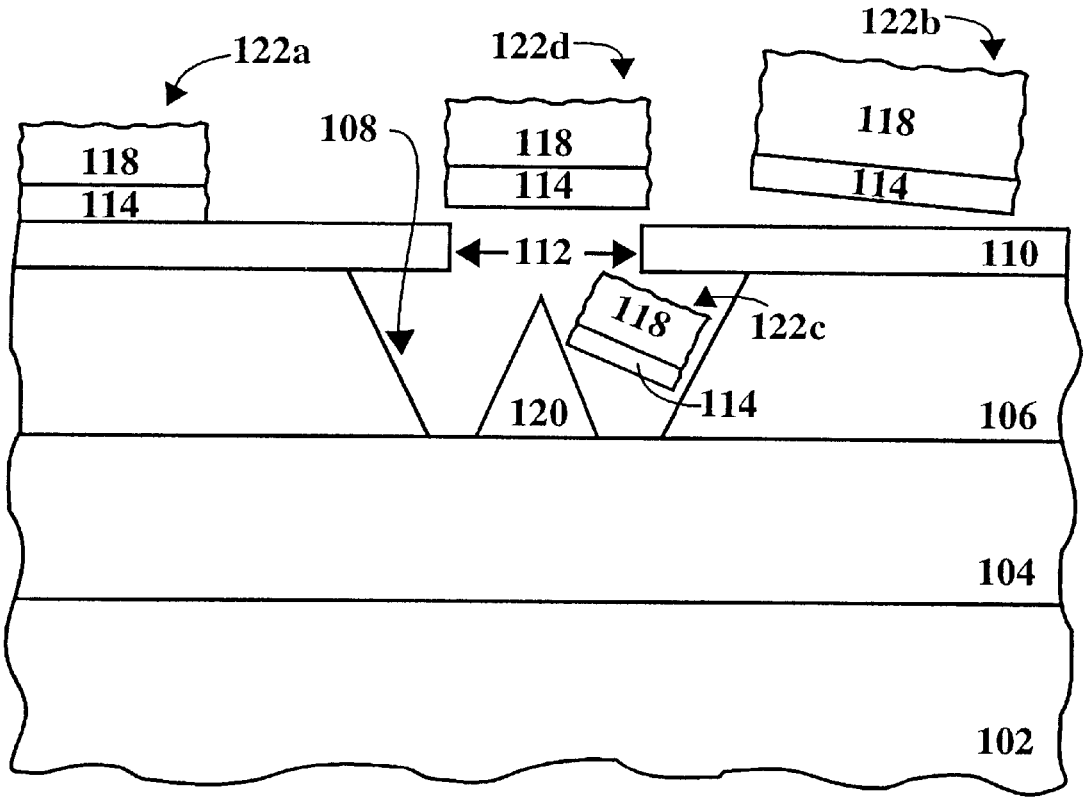
FIG. 1E (Prior Art)
FIG. 1E is a side sectional view illustrating a lift-off removal process.
Figure 2A:
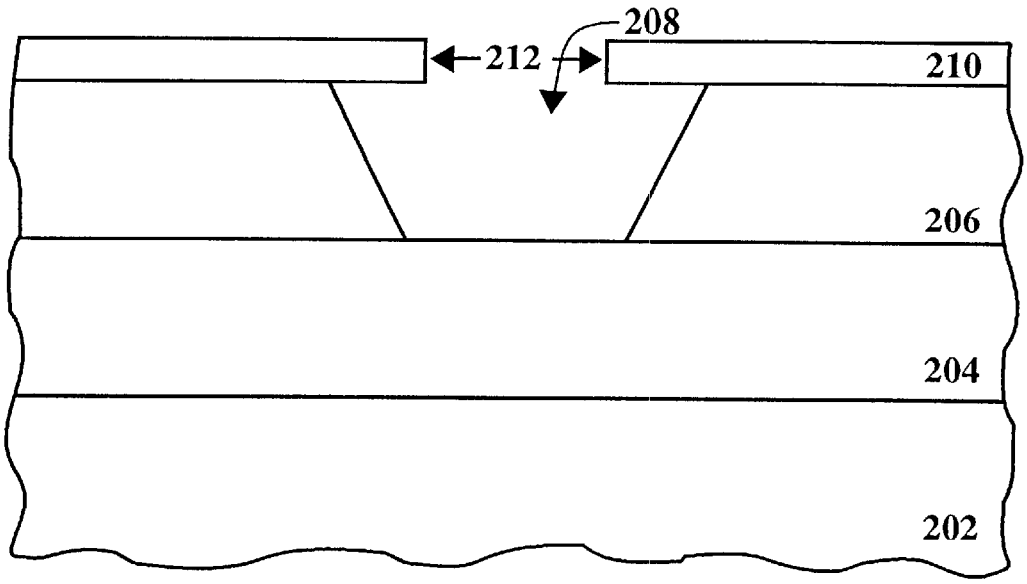
FIG. 2A is a side sectional view depicting initial formation steps used to manufacture a field emitter structure in accordance with the present claimed invention.

Referring now to FIG. 2A, a side sectional view depicting initial formation seeps used to manufacture a field emitter structure in accordance with the present claimed invention is shown. As shown in FIG. 2A, a first conductive layer or row electrode 202 has a resistive layer 204 disposed thereon. (The present invention is, however, also well suited to various other configurations in which, for example, the first conductive layer resides under only portions of the resistive layer.) An inter-metal dielectric layer 206, comprised, for example, of silicon dioxide, is disposed above resistive layer 204. A cavity 208 is formed within inter-metal dielectric layer 206. A second conductive layer or gate electrode 210 resides above inter-metal dielectric layer 206. A hole or opening 212 is formed through gate electrode 210 directly above cavity 208. Opening 212 is used to form the field emitter which will reside within cavity 208.

Figure 2B:
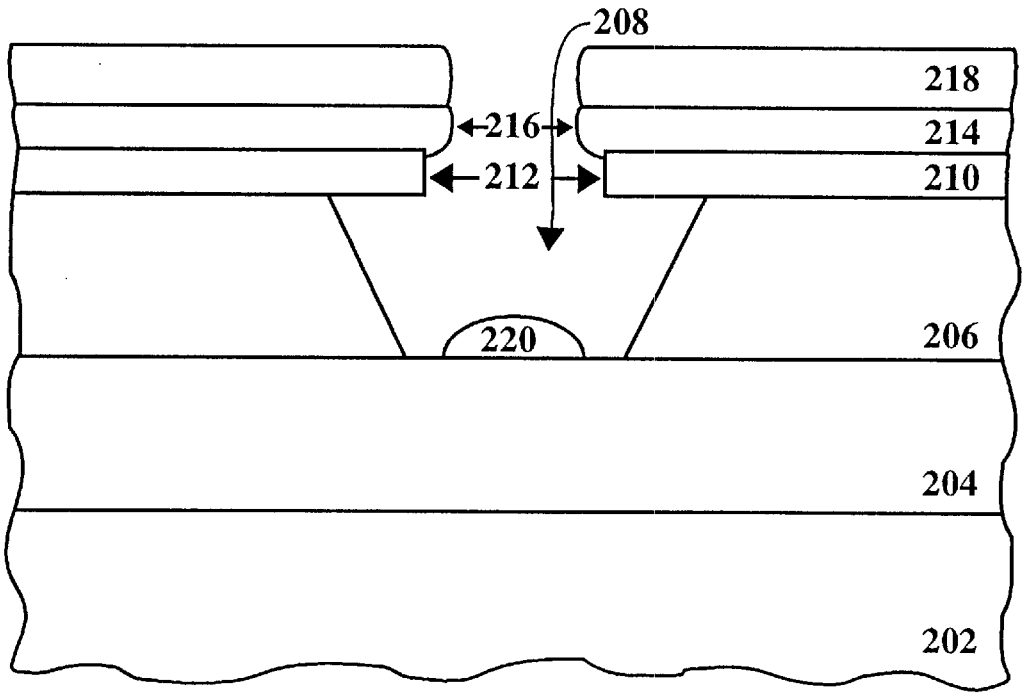
FIG. 2B is a side sectional view depicting an initial deposition of electron emissive material directly onto a gate electrode in accordance with the present claimed invention.

Referring now to FIG. 2B, a side sectional view depicting the deposition of electron emissive material over an underlying lift-off layer in accordance with the present claimed invention is shown. Lift-off layer 214 is formed using an angled physical vapor deposition of, for example, aluminum, aluminum oxide, and the like. In the present embodiment, the electron emissive material of closure layer 216 is comprised of molybdenum which is deposited using a physical vapor deposition such as, for example, an e-beam evaporative technique. Although molybdenum is used as the electron emissive material in the present embodiment, the present invention is also well suited to the use of various other electron emissive materials deposited using various other deposition techniques. The electron emissive material is also deposited into cavity 208 as shown by structure 220.

Figure 2C:
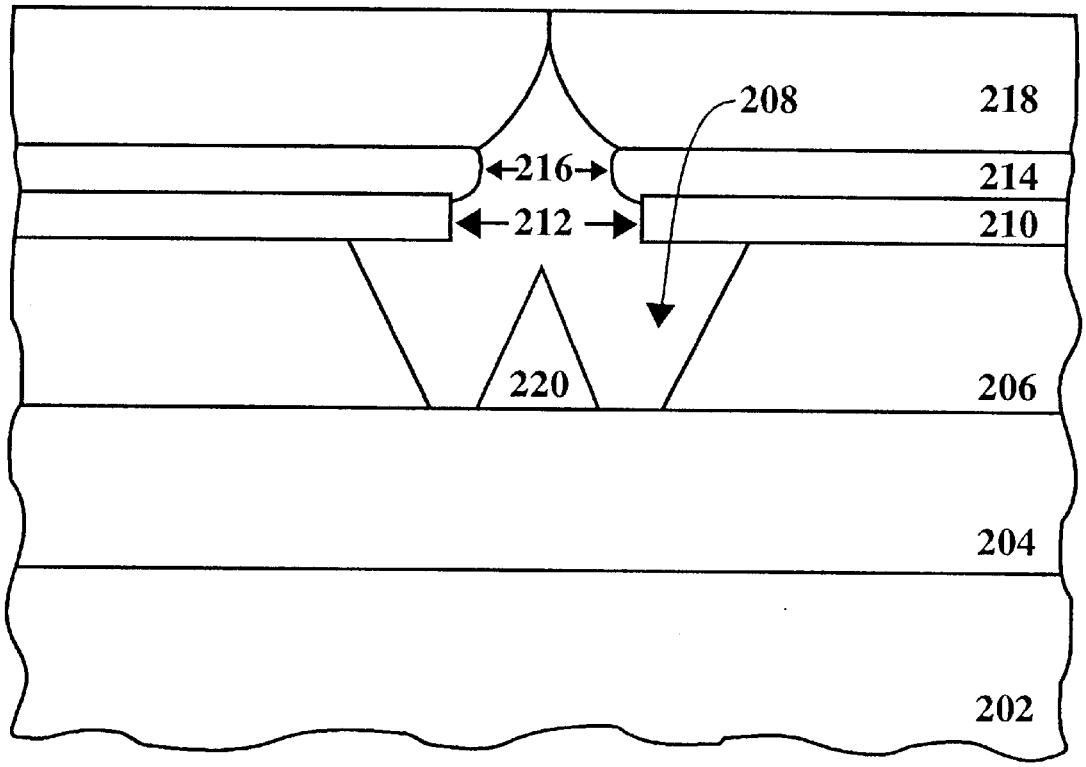
FIG. 2C is a side sectional view illustrating a completed closure layer and an electron emissive element in accordance with the present claimed invention.

With reference next to FIG. 2C, a side sectional view illustrating a completed closure layer and an electron emissive element in accordance with the present claimed invention is shown. As shown in FIG. 2C, closure layer 216 completely seals cavity 208. Furthermore, as the electron emissive material is deposited onto gate electrode 210 and through openings 212 and 216, a Spindt-type emitter 220 is formed within cavity 208. Although a Spindt-type emitter is specifically mentioned in the present embodiment, the present invention is also well suited to the use of various other types of emitters.

Figure 3:
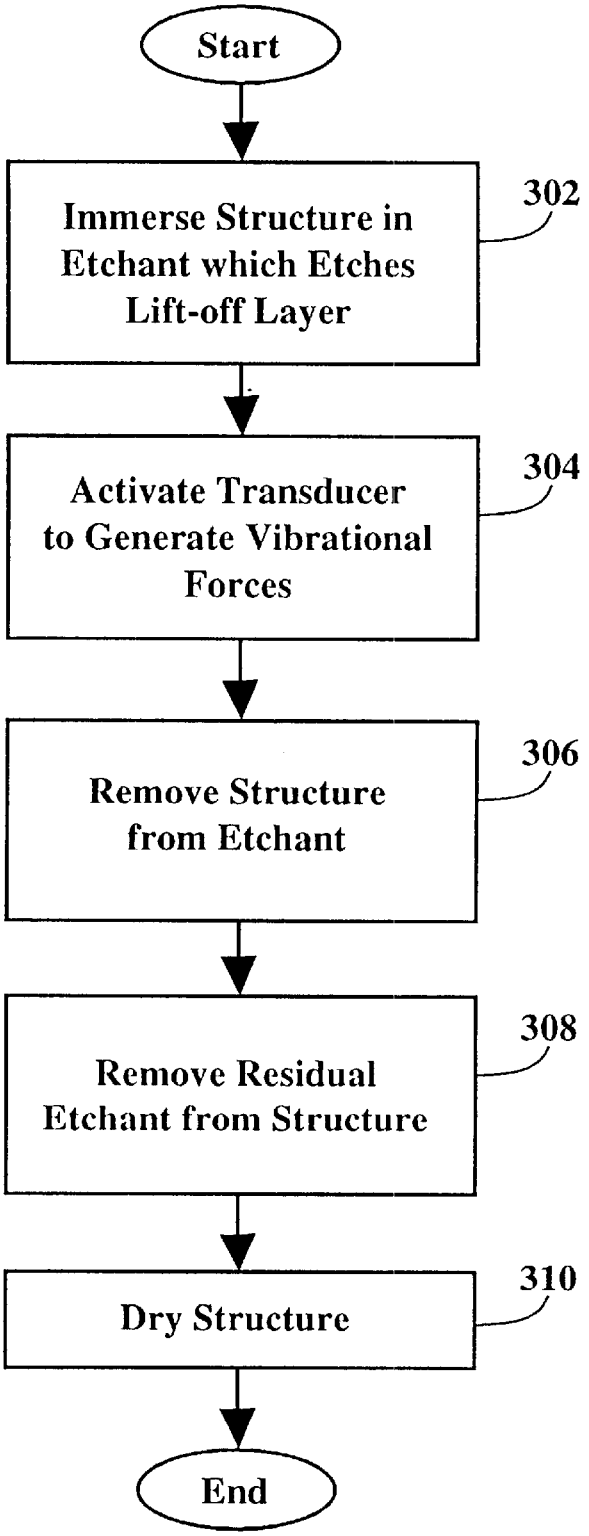
FIG. 3 is a flow chart of the steps used to remove lift-off and closure layers in accordance with the present claimed invention.
Figure 4:
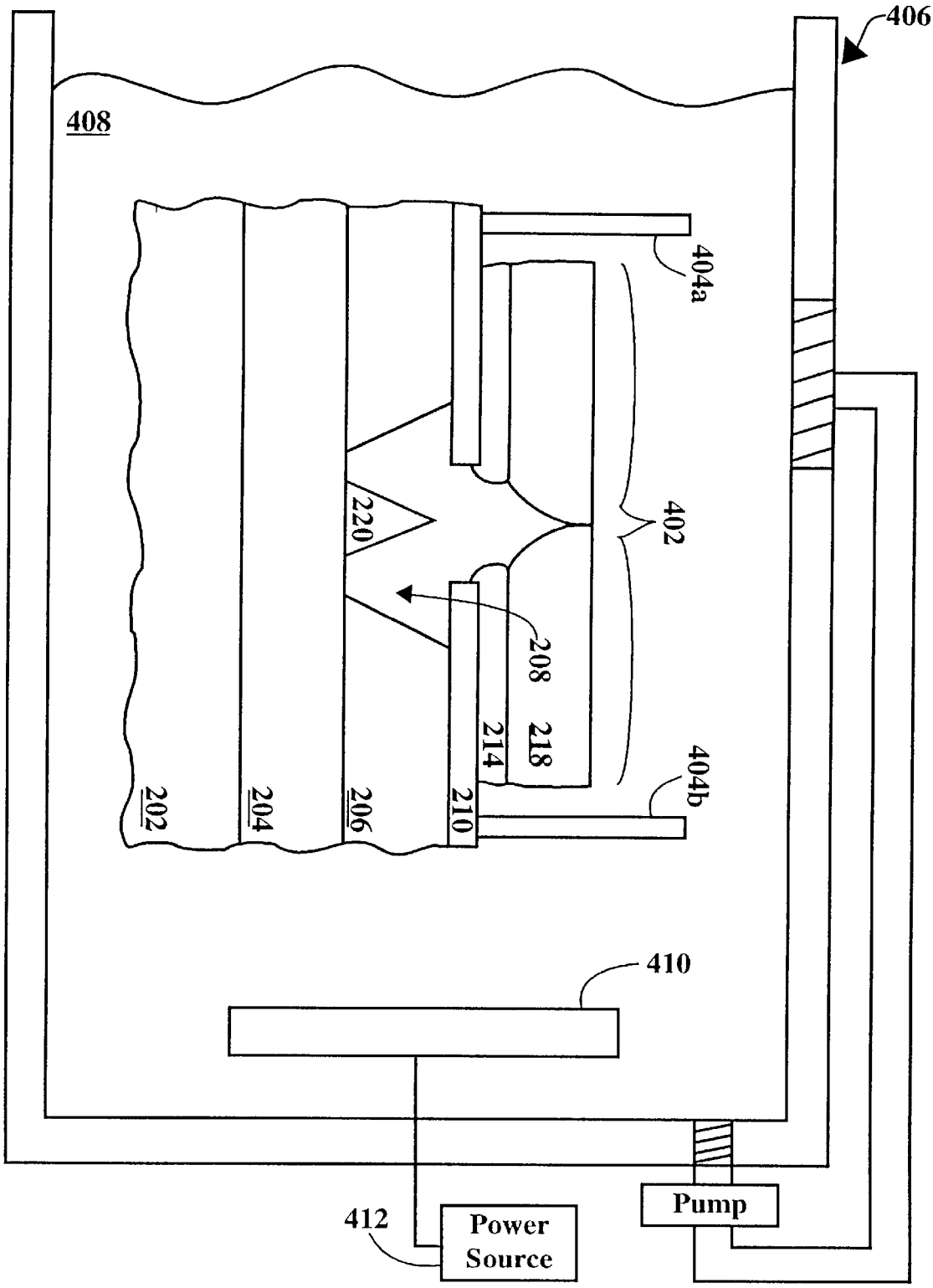
FIG. 4 is a schematic side view of a transducer-equipped etch tank containing a field emitter structure in accordance with the present claimed invention.

With reference next to FIG. 3, a flow chart of the steps of the present invention used to remove the lift-off and closure layers is shown. The steps of FIG. 3 will be described in conjunction with FIGS. 4 and 5 in order more clearly describe the lift-off and closure layer removal method of the present claimed invention. As shown in step 302, the present invention immerses the field emitter structure in an etchant which etches the lift-off layer. FIG. 4, provides a schematic side view of a transducer-equipped etch tank containing a field emitter structure in accordance with the present claimed invention. It will be understood that although lift-off layer 214 and closure layer 218 are depicted as covering the entire surface gate electrode 210 in FIGS. 2B and 2C, lift-off layer 214 and closure layer 218 are photolithographically defined. That is, lift-off layer 214 and closure layer 218 typically exist only above groups of field emitters comprising a sub-pixel region. Thus, lift-off layer 214 and closure layer 218 are more typically disposed in discrete regions or "buttons" along the top surface of gate electrode 210. In embodiments having focus walls, the focus walls reside peripherally surrounding the of lift-off and closure layer buttons. For purposes of clarity, FIG. 4 depicts a portion of a field emitter structure having a photolithographically defined button 402 of lift-off and closure layer material residing above a single field emitter 220. In this embodiment, button 402 is peripherally surrounded by focus walls 404*a* and 404*b*.

Referring still to step 302 of FIG. 3, in the present embodiment, the present invention immerses the field emitter structure in a transducer-equipped etch tank 406. The transducer-equipped etch tank contains an etchant 408 which "attacks" or etches lift-off layer 214. In the present embodiment, etchant 408 is comprised of approximately 90–110 molar sodium hydroxide. Although such an etchant is used in the present embodiment, the present invention is also well suited to the use of various other types of etchants, and various other molarities of sodium hydroxide.

Referring next to step 304 of FIG. 3, the present invention activates a transducer within the etchant tank to generate vibrational forces. In the embodiment of FIG. 4, the transducer 410 resides near the bottom of etchant tank 406 and is coupled to a power source 412. The vibrational forces are imparted to lift-off layer 214 as well as to the rest of the field emitter structure. In the present embodiment, transducer 410 is a megasonic transducer which generates vibrations having a frequency of approximately 950 KHz. Although such a megasonic frequency is used in the present embodiment, the present invention is also well suited to using higher or lower frequencies. Megasonic transducer systems are commercially available, for example, from Kaijo Corporation of Tokyo, Japan.

Referring still to FIG. 4 and step 304 of FIG. 3, the vibrational forces generated by transducer 410 acting in conjunction with etchant 408, causes lift-off layer 214 to separate from underlying gate electrode 210. As lift-off layer 214 lifts from gate electrode 210, overlying closure layer 218 is also removed from above gate electrode 210. In the present embodiment, the combinational effect of sodium hydroxide etchant 408 and megasonic transducer 410 causes lift-off layer 214 and overlying closure layer 218 to separate from gate electrode 210 after only a few seconds. More specifically, in the present embodiment button 402 of lift-off layer 214 and closure layer 218 lifts from gate electrode 210 within approximately 25–50 seconds. Thus, unlike prior art methods, the present invention does not subject the field emitter structure to an etchant for a prolonged period of time. As a result, in the present invention, the integrity of the field emitters is not compromised by extended deleterious exposure to an etchant. Similarly, focus walls 404*a* and 404*b* are not adversely affected, due to the very brief duration of their exposure to etchant 408.

Figure 5:
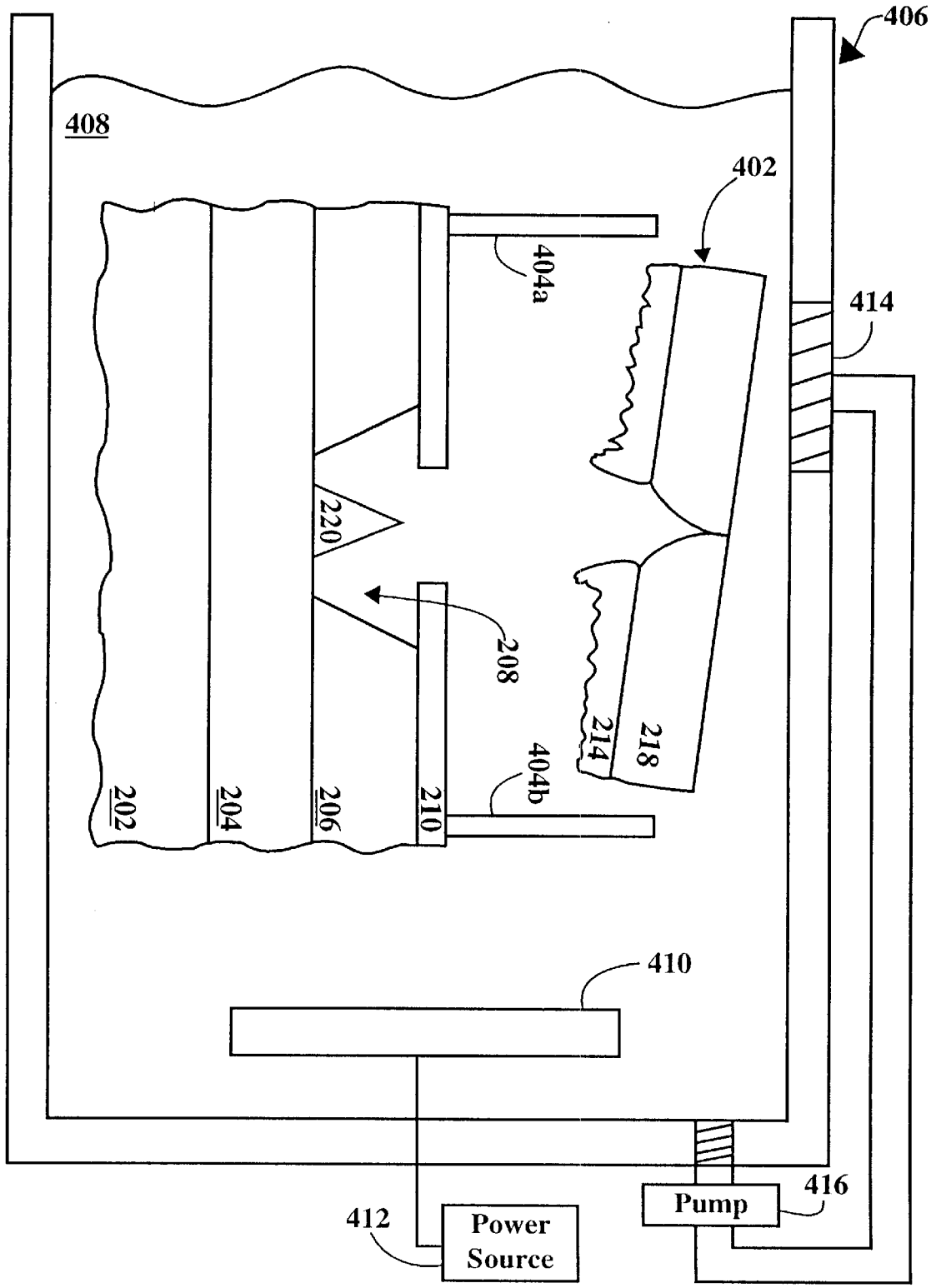
FIG. 5 is a schematic side view of a transducer-equipped etch tank containing a field emitter structure having a lift-off and closure layer button separated therefrom in accordance with the present claimed invention.

With reference next to FIG. 5, a schematic side view of a transducer-equipped etch tank containing a field emitter structure having lift-off and closure layer button 402 separated therefrom, in accordance with the present claimed invention, is shown. As shown in FIG. 5, due to the combinational effect of etchant 408 and transducer 410, button 402 separates from gate electrode 210. Additionally, unlike prior art approaches in which the separated button may redeposit onto the gate electrode, in the present invention, the vibrational forces generated by transducer 410 insure that lifted button 402 does not redeposit back onto gate electrode 210. That is, lifted button 402 migrates away from gate electrode 210 despite being peripherally surrounded by focus walls 404*a* and 404*b*. Furthermore, in the present embodiment, a filter 414 coupled to a recirculating pump 416 filters lifted buttons from etchant tank 406. Thus, etchant 408 does not become adversely contaminated with lifted button and residual debris. Although filter 414 is depicted as being quite small for purposes of the clarity, it will be understood that filter 414 will be much larger than depicted in FIG. 5.

Referring still to FIG. 5, the combinational effect of etchant 408 and transducer 410 causes button 402 to cleanly separate from gate electrode 210. That is, button 402 separates from gate electrode 210 in one "chunk". Thus, the present invention reduces the formation of small pieces of lift-off and closure layer material. In so doing, the present invention decreases the possibility that a small piece of lift-off and closure layer material will redeposit into cavity 208 and short field emitter 220 to gate electrode 210. Many prior art approaches often "re-dip" the field emitter structure into the etchant in an attempt to insure that short-causing small pieces of lift-off and closure layer material are dissolved. Such a re-dip process can dull the tips of the field emitters and, consequently, degrade the performance of the field emitter structure. The present invention, however, eliminates the need to perform such re-dipping of the field emitter structure into the etchant. Thus, the present invention does not suffer from tip dulling drawbacks associated with the prior art.

Referring next to step 306 of FIG. 3, the present invention removes the field emitter structure from etchant tank 406 of FIGS. 4 and 5. At this point, the buttons of lift-off and closure layer material have been vibrationally and chemically lifted from gate electrode 210.

Referring now to step 308 of FIG. 3, the present invention removes residual etchant from the field emitter structure. In the present embodiment, the residual etchant is removed from the field emitter structure by rinsing the field emitter structure for a period of approximately 5–10 minutes with deionized water having a temperature of approximately 80–85 Celsius. Although such a rinsing process is used in the present embodiment, the present invention is also well suited to removing residual etchant using various other rinsing solutions or rinsing conditions.

With reference now to step 310 of FIG. 3, the present invention then dries the field emitter structure to remove any fluids which may remain after the completion of steps 302–308 of FIG. 3. In the present embodiment, the field emitter structure is dried using an alcohol-based fluid displacement drying process such as, for example, a Marangoni drying process. In a Marangoni drying process, alcohol is used to displace water present on the field emitter structure. After the water is displaced the alcohol cleanly evaporates. In so doing, the field emitter structure is left dry and free of contaminates. Marangoni dryers are commercially available from, for example, Yield-Up Inc., of Sunnyvale, Calif. Many prior art approaches dry the field emitter structure using a 2–24 hour methanol soak. The Marangoni drying process used in the present invention, is able to accomplish the drying operation in a matter of minutes. Thus, throughput is substantially enhanced using the Marangoni drying process of the present invention.

Thus, the present invention provides a lift-off and closure layer removal method which does not require exposing the field emitter structure to etchants for a prolonged period of time. The present invention further provides a lift-off and closure layer removal method which does not require subsequent rubbing or tape-peeling processes to completely remove the lift-off and closure layers. Additionally, the present invention provides a lift-off and closure layer removal method which is compatible with the use of focus walls.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

I claim:

1. In a field emitter structure having a cavity formed into an insulating layer overlying at least a portion of a first electrically conductive layer, and a second electrically conductive layer having an opening formed above said cavity, wherein said second electrically conductive layer has lift-off layer and a closure layer disposed thereon, a method for removing said lift-off layer and said closure layer, said method comprising the steps of:

a) immersing said field emitter structure in an etchant which etches said liftoff layer;

b) activating a megasonic transducer immersed in said etchant to subject said lift-off layer of said field emitter structure to megasonic vibrational forces generated by said megasonic transducer, said megasonic vibrational forces in conjunction with said etchant causing said lift-off layer and said overlying closure layer to be removed from said second electrically conductive layer;

c) removing said field emitter structure from said etchant;

d) removing residual etchant from said field emitter structure; and e) drying said field emitter structure.

2. The lift-off layer and closure layer removal method as recited in claim 1 wherein step a) further comprises:

immersing said field emitter structure in an etchant comprised of sodium hydroxide.

3. The lift-off layer and closure layer removal method as recited in claim 2 wherein step a) further comprises:

immersing said field emitter structure in an etchant comprised of approximately 90–110 molar sodium hydroxide.

4. The lift-off layer and closure layer removal method as recited in claim 1 wherein step a) further comprises:

immersing said field emitter structure in said etchant for approximately 25–50 seconds.

5. The lift-off layer and closure layer removal method as recited in claim 1 wherein said megasonic transducer generates said megasonic vibrational forces having a frequency of approximately 950 MHz.

6. The lift-off layer and closure layer removal method as recited in claim 1 wherein step d) further comprises:

rinsing said field emitter structure for a period of approximately 5–10 minutes with deionized water having a temperature of approximately 80–85 Celsius.

7. The lift-off layer and closure layer removal method as recited in claim 1 wherein step e) further comprises:

drying said field emitter structure using an alcohol-based fluid displacement drying process.

8. A method for forming a field emitter structure comprising the steps of:

a) creating a structure having a cavity formed into an insulating layer overlying a first electrically conductive layer, said structure having a second electrically conductive layer overlying said insulating layer with an opening formed above said cavity;

b) depositing a lift-off layer over said second electrically conductive layer;

c) depositing a layer of electron emissive material over said lift-off layer such that said electron emissive material covers said opening in said second electrically conductive layer and forms an electron emissive element within said cavity;

d) immersing said field emitter structure in an etchant which etches said liftoff layer;

e) activating a megasonic transducer immersed in said etchant to subject said lift-off layer of said field emitter structure to megasonic vibrational forces generated by said megasonic transducer, said megasonic vibrational forces in conjunction with said etchant causing said lift-off layer and said overlying layer of electron emissive material to be removed from said second electrically conductive layer;

f) removing said field emitter structure from said etchant;

g) removing residual etchant from said field emitter structure; and h) drying said field emitter structure.

9. The field emitter structure forming method as recited in claim 8 wherein step d) further comprises:

immersing said field emitter structure in an etchant comprised of sodium hydroxide.

10. The field emitter structure forming method as recited in claim 9 wherein step d) further comprises:

immersing said field emitter structure in an etchant comprised of approximately 90–110 molar sodium hydroxide.

11. The field emitter structure forming method as recited in claim 8 wherein step d) further comprises:

immersing said field emitter structure in said etchant for approximately 25–50 seconds.

12. The field emitter structure forming method as recited in claim 8 wherein said megasonic transducer generates said megasonic vibrational forces having a frequency of approximately 950 MHz.

13. The field emitter structure forming method as recited in claim 8 wherein step g) further comprises:

rinsing said field emitter structure for a period of approximately 5–10 minutes with deionized water having a temperature of approximately 80–85 Celsius.

14. The field emitter structure forming method as recited in claim 8 wherein step h) further comprises:

drying said field emitter structure using an alcohol-based fluid displacement drying process.

15. A method for selectively removing a lift-off layer and a closure layer from a gate electrode of a field emitter structure without substantially etching an electron emissive element of said field emitter structure, said method comprising the steps of:

a) immersing said field emitter structure in an etchant bath of sodium hydroxide, said etchant bath of sodium hydroxide etching said lift-off layer;

b) activating a megasonic transducer immersed in said etchant bath of sodium hydroxide to subject said lift-off layer of said field emitter structure to megasonic vibrational forces generated by said megasonic transducer, said vibrational forces in conjunction with said etchant bath of sodium hydroxide causing said lift-off layer and said overlying closure layer to be removed from said gate electrode;

c) removing said field emitter structure from said etchant bath of sodium hydroxide;

d) removing residual etchant from said field emitter structure by rinsing said field emitter structure with deionized water; and e) drying said field emitter structure using an alcohol-based fluid displacement drying process.

16. The method for selectively removing a lift-off layer and a closure layer from a gate electrode as recited in claim 15 wherein step a) further comprises:

immersing said field emitter structure in an etchant bath comprised of approximately 90–110 molar sodium hydroxide.

17. The method for selectively removing a lift-off layer and a closure layer from a gate electrode as recited in claim 15 wherein step a) further comprises:

immersing said field emitter structure in said etchant bath of sodium hydroxide for approximately 25–50 seconds.

18. The method for selectively removing a lift-off layer and a closure layer from a gate electrode as recited in claim 15 wherein said megasonic transducer generates said megasonic vibrational forces having a frequency of approximately 950 MHz.

19. The method for selectively removing a lift-off layer and a closure layer from a gate electrode as recited in claim 15 wherein step d) further comprises:

rinsing said field emitter structure for a period of approximately 5–10 minutes with deionized water having a temperature of approximately 80–85 Celsius.

* * * * *